US007279035B2

(12) United States Patent
Barnat

(10) Patent No.: US 7,279,035 B2
(45) Date of Patent: Oct. 9, 2007

(54) METHOD OF SELECTING A BINDER FOR A CHIPSEALING PROCESS BASED ON ITS ADHESION INDEX

(75) Inventor: James Barnat, Wichita, KS (US)

(73) Assignee: Semmaterials, LP, Tulsa, OK (US)

( * ) Notice: Subject to any disclaimer, the term of this patent is extended or adjusted under 35 U.S.C. 154(b) by 615 days.

(21) Appl. No.: 10/926,174

(22) Filed: Aug. 25, 2004

(65) Prior Publication Data

US 2006/0070695 A1 Apr. 6, 2006

(51) Int. Cl.
*C09D 195/00* (2006.01)
*E01C 11/00* (2006.01)

(52) U.S. Cl. ..... 106/281.1; 404/17; 404/72

(58) Field of Classification Search ..... 106/281.1; 404/17, 72

See application file for complete search history.

(56) References Cited

U.S. PATENT DOCUMENTS

| | | | | |
|---|---|---|---|---|
| 4,948,431 | A | 8/1990 | Strickland et al. | |
| 5,069,578 | A | 12/1991 | Bense et al. | |
| 5,120,777 | A | 6/1992 | Chaverot et al. | |
| 5,743,950 | A | 4/1998 | Hendriks et al. | |
| 5,827,568 | A | 10/1998 | Wickett | |
| 5,895,173 | A | 4/1999 | O'Brien et al. | |
| 6,156,828 | A | 12/2000 | Wickett | |
| 6,444,258 | B1 | 9/2002 | Terry | |
| 2002/0170464 | A1 | 11/2002 | Larsen et al. | |
| 2002/0182009 | A1 | 12/2002 | Barnat et al. | |
| 2002/0190138 | A1 | 12/2002 | Terry | |
| 2003/0191212 | A1* | 10/2003 | Yamazaki et al. | 524/59 |

FOREIGN PATENT DOCUMENTS

| | | | |
|---|---|---|---|
| EP | 0397549 | | 11/1990 |
| EP | 0479637 | B1 | 8/1992 |
| EP | 0690173 | A1 | 3/1996 |
| EP | 1069241 | B1 | 6/2004 |
| FR | 2716470 | A1 | 8/1995 |
| FR | 2777300 | A1 | 10/1999 |
| WO | WO 90/11331 | | 10/1990 |
| WO | WO 91/00315 | | 1/1991 |
| WO | WO 97/20890 | | 6/1997 |
| WO | WO 97/21769 | | 6/1997 |
| WO | WO 99/19566 | | 4/1999 |
| WO | WO 01/62852 | | 8/2001 |

OTHER PUBLICATIONS

"Hugging The Road Chip Seal Application Holds On Tight To Aggregate," Roads & Bridges, Scranton Gillette Communications, Des Plaines, IL (USA), vol. 42, No. 6, Jun. 2004, pp. 32-34.

Praktischer StraBenbau in elner Groβstadt—Erfahrungen mit dem bituminosen StraBenbau in Frankfurt a. M.—"Das Problem der Haftung zwischen Kohlenwasserstoffbindemittein und Gesteinskomungen" Bitumen 1980, no month provided 42 (3), p. 65, 79-84 This reference relates to the problem with adhesion between carbon hydrogen binders and rock granulation.

"Developments in Adhesion Agent Testing in New Zealand" New Zealand Roading Symposium 1987, no month provided , vol. 2, p. 239-247.

"Clean, One-Size Crushed Stone Best for Chips Seals" Roads and Bridges, (Mar. 1991) p. 48-51.

"Untersuchungen zum Haftverhalten zwischen Bindemittel und Gestein" Strasse und Autobahn (Jan. 1992) 43 (1), p. 9-11. This reference relates to studies regarding the bonding behavior between binders and rock.

"Adhesion Between Aggregate and Binder" The Asphalt Yearbook 1993, no month provided, p. 23-33.

"Net Adsorption Test for Chip-Sealing Aggregates and Binders" Transportation Research Record, 1995, no month provided, No. 1507, p. 1-12.

"Assessing Binder/Aggregate Bond in Fundamental Units" Highways and Transportation, (Dec. 1995) 42 (12), p. 17-18, 20.

"A Modified SHRP Net Adsorption Test" Eurasphalt & Eurobitume Congress, 1996, no month provided, p. 1-12.

"Analyses of Tensile Failure Properties of Asphalt-Mineral Filler Mastics" Journal of Materials in Civil Engineering (Nov. 1998) 10 (4), p. 256-262.

"Une nouvelle gamme de bitumes modifies pour enrobage" Revue Generale des Routes (Oct. 2001) No. 799 p. 60-69 This reference relates to defining the objectives of bitumen modification. It discusses that elastomer modification simultaneously improves binder properties at high temperature and those at low temperature. Various SBS-modified binders have been characterized using European and American SHRP tests.

"Determination des caracteristiques de reference des bitumes purs produits dans les raffineries francaises" Revue Generale des Routes (Nov. 2002) No. 811, p. 40-46 This reference relates to testing bitumen manufactured in French refineries between 1999 and 2002 to determine paving grades. The tests included, but were not limited to, RTFOT aging, complex modulus and tensile testing.

"Les revetements superficiets: une tente et difficile progression vers le marquage CE" Revue Ganarale des Routes, (Jun. 2003) No. 818, p. 46-47 This reference relates to the slow process in developing European specifications for chip seals.

"Mise en Oeuvre de la Directive produits de Construction (DPC)" Revue Generale des Routes, (Jun. 2003) No. 818, p. 49-51 This reference relates to the implementation of Construction Products Directive (CPD) Europen standards for bituminous binders. It distinguishes three sub-families of "Bitumens for road construction and surface treatment of roads": pure or polymer-modified bitumens, fluxed or cut-back bitumens and, finally, bitumen emulsions.

(Continued)

*Primary Examiner*—David M Brunsman
(74) *Attorney, Agent, or Firm*—Molly D. McKay

(57) ABSTRACT

A method of selecting a binder for a chipsealing process is provided. This method includes measuring the Adhesion Index of at least one binder and selecting a binder with a desirable Adhesion Index for the chipsealing process. The selected binder should have an Adhesion Index no greater than about 3.75 when calculated according to the most preferred method of the present invention. Preferably, the selected binder is applied to a surface and then aggregate is applied within the time parameters defined by the Adhesion Index of the binder to form a chipsealed surface. Preferably, substantially all of the aggregate bonds to the binder without the need for compacting the paved surface.

35 Claims, 5 Drawing Sheets

OTHER PUBLICATIONS

"Caracteristiques des bitumes polymere et speciaux et les performances des enrobes" Revue Generale des Routes (Feb. 2003) No. 814, p. 22-24 This reference relates to characteristics of polymer modified and special bitumens and the performance of asphalt mixes. It discusses selecting binders among commercial products, determining the characteristics of asphalt concrete, and identifying the properties of a selected binder before and after artificial aging.
"Normalisation europeenne des bitumes modifies Etat d'avancement des travaux du groupe de travail WG4 du CEN/TC336" Revue Generale des Routes, (Feb. 2003) No. 814, p. 25-29 This reference relates to the progress of the work of the European Standardization Committee regarding the harmonization of test methods and specifications relating to bituminous mixes in Europe.
"Application de nouvelles methods d'essais rheologiques <<post-Superpave>> pur mieux caracteriser et differencier les liants modifes" Revue Generale des Routes (Feb. 2003) No. 814, p. 31-36. This reference relates to applications of new "post-superpave" rheological test methods to better characterize and differentiate bituminous binders.
"Evaluation de la performance intrinseque en fatigue des enrobes bitumeneux : Application d'une approche globale et proposition e'une methodologie d'essai" Revue Generale des Routes (Feb. 2003) No. 814, p. 37-42 This reference relates to the evaluation of intrinsic fatigue performance of bituminous mixes and proposals for new test procedures.
"Une nouveau concept pertinent de specification AASHTO MP1-A applique aux liants modifies: performance du SBS a basse temperature" Revue Generale des Routes (Feb. 2003) No. 814, p. 43-47 This reference relates to assessing the influence of the presence of a polymer on the low temperature properties of binders.
"Nynas Nyguard: Developpements locaux pour gamme globale coherente" Revue Generale des Routes (Feb. 2003) No. 814, p. 48-53 This reference relates to the development of performance oriented specifications for bitumen binders. The work included the creation of a coherent binder range.
Viscosite a taux de cisailliment nul et omierage: application aux liants modifiees polymeres Revue Generale des Routes (Feb. 2003) No. 814, p. 62-66 This reference relates to evaluating the contribution of the binder to rutting using a rheology test, such as a zero shear viscosity test.
"Les bitumes polymeres chez Eurovia: le meilleur de chaque monde" Revue Generale des Routes (Feb. 2003) No. 814, p. 67-75 This reference relates to how to evaluate the performance of polymer modified bitumens. The improvements of test methods together with the search for relevant performance criteria through a better understanding of the link between binder and mix properties are reviewed.
"Liants modifies d'enrobage: La nouvelle gamma Appia" Revue Generale des Routes (Feb. 2003) No. 814, p. 76-80 This reference relates to the objectives of the modification of bitumens by polymers for use in asphaltic concretes and shows the interest of the choice of elastomers to meet road engineering needs.
"Proprietes mecaniques d'enrobes au bitume elastomeric reticule" Revue Generale des Routes (Feb. 2003) No. 814, p. 54-61 This reference relates to the results of tests performed on binder including vialit pendulum cohesion and direct tension at low temperatures. The advantages of adding elastomers to bitumen also has been shown.
"Determination des caracteristiques de reference des bitumes purs produit dans les raffineries francaise" Revue Generale des Routes (Apr. 2004) No. 827, p. 18-24 This reference relates to determining reference characteristics of pure bitumens produced in French refineries in 2001.
"Les bitumes de Total et de CEPSA au 3e congres Eurasphalt & Eurobitume de vienne (Autriche)" Revue Generale des Routes (Apr. 2004) No. 827, p. 31-35 This reference discusses most of the 8 technical sessions of the 3rd Eurasphalt and Eurobitume Congress in Vienna, Austria, which was to be held in May 2004.
"Mieux comprendre les bitumes pour developer les liants de demain Contribution de Nynas au congres Eurobitume & Eurasphalt 2004" Revue Generale des Routes (Apr. 2004) No. 827, p. 36-41 This reference relates to predicting binder properties by testing low temperature cracking, rutting or fatigue resistance of hot mixes of wax or rheological properties of bituminous binders.
"Fissuration thermique les enrobes bitumineux: experimentation et modelisation" Revue Generale des Routes (Apr. 2004) No. 827, p. 43-52 This reference relates to characterization of the low-temperature cracking resistance of bituminous mixture pavement materials.
Comportement visco-elastique lineaire des liants et des enrobes bitumineux a basse temperature Revue Generale des Routes (Mar. 2004) No. 826, p. 57-65 This reference relates to studies in the low-temperature behavior of bituminous mixtures and highlights the links between the binder and the mix properties.
"Validation of Binder Properties Used to Predict Water Sensitivity of Asphalt Mixtures" Asphalt Paving Technology, 1933, no month provided, vol. 62, p. 172-222.
"Development of SHRP Binder Specification" Asphalt Paving Technology, 1993, no month provided, vol. 62, p. 481-507.
"Development of SHRP Mixture Specification and Design and Analysis System" Asphalt Paving Technology, 1993, no month provided, vol. 62, p. 508-528.
"Variation in Hot Mix Asphalt Mix Design Properties" Asphalt Paving Technology, 1993, no month provided, vol. 62, p. 708-737.
Abstract of "Influence of Adhesive Additions on Mechanical Properties of Road Mineral-Asphalt Mixtures" Proceedings of the Conference Strategic Highway Research Program and Traffice Safety on Two Continents, 1993 (VTI Konferens Nr 1A) (1994), no month provided, No. 1A: 3.
"Viscosity Mixing Rules for Asphalt Recycling" Transportation Research Record, 1995,* No. 1507, p. 78-85.
"Reevaluation of Seal Coating Practices in Minnesota" Transportation Research Record, 1995, no month provided, No. 1507, p. 30-38.
"U.K. Design Procedure for Surface Dressing" Transportation Research Record, 1995, no month provided, No. 1507, p. 13-22.
Abstract of "Development of Micro-Rheometer for Hot Mix Asphalt" 10th AAPA International Flexible Pavements Conference, 1997, no month provided, vol. 1.
Abstract of "Specifying for Durability for Bituminous Surfacings—The Importance of Binder Rheology" Proceedings of the Second European Symposium on Performance and Durability of Bituminous Materials, (Apr.1997).
Abstract of "Investigations on bitumen polymer composition as insulating seal materials" 2nd Eurasphalt and Eurobitume Congress (Sep. 2000) Book 2—Session 2.
Abstract of "Durability evaluation of asphalt mixtures modified with recycled tire rubber" Journal of Solid Waste Technology and Management, (Nov. 2001) vol. 27 (Nos. 3-4).
Abstract of "Modelling short-term aging of Asphalt Binders usng the Rolling Thin Film Oven Test" Canadian Journal of Civil Engineering 2002, no month provided, vol. 29, (No. 1).
Abstract of "Fatigue testing and evaluation of asphalt binders using the dynamic shear rheometer" ASTM Journal of Testing and Evaluation, (Jul. 2002) vol. 30, (No. 4).
Abstract of "Viscoelastic modelling of straight run and modified binders using the matching function approach" International Journal of Pavement Engineering, (Mar. 2002) vol. 3 (No. 1).
Abstract of "Une Technique de Perfectionnement des Materiaux de Dallage en Beton Ashphalte" Routes et development—Comptes rendus du colloque international, Paris (May 1984) This reference relates to techniques for upgrading asphalt pavement materials.
Abstract of "Les Enduits superficiels et les routes economiques" Laboratoire Central des Ponts et Chausses, (Oct. 1989) This reference relates to testing adhesion agents.
Abstract of "Microflex B-Gerland Routes—Enrobes Speciaux" Avis Technique Chaussees (May 1997) No. 98 This reference relates to ultra-thin hot mix technology.
Abstract of "Sampling and Examination of Bituminous Mixtures for Roads and other Paved Areas. Part 3. Methods for Design and Physical Testing" British Standard, 1985, no month provided, No. BS 598: PA.
Abstract of "Soft Ashphalt—Needs, Mix Proportions and Experience" Nordiska Vaegtekniska Foerbundets XIV Kongress, 4-6(Jun. 1984).

Abstract of "Adhesion agents for surface dressing in New Zealand, thin bituminous pavement surfacings" Report of a workshop at the New Zealand roading symposium (1985), no month provided.
Abstract of "Non-Volatile flux for chipsealing: Laboratory study interim report" Transfund New Zealand Research Report (1996), no month provided, No. 71.
Abstract of "Binder Characterization and Evaluation, vol. 3: Physical Characterization" Strategic Highway Research Program (Apr. 1994).
Abstract of "Asphalt Research Leads to Longer Road Life" Bett Roads (Oct. 1, 1988), vol. 58 (No. 10).
Abstract of "Chip Seals for High Traffice Pavements" Transportation Research Record (Jan. 1, 1990), No. 1259.
Abstract of "High-Traffic Chip-Seal Construction: The Tulsa Test Road" Transportation Research Record (Jan. 1, 1991), No. 1300.
Abstract of "Criteria for Use of Seal Coats on Airport Pavements" Federal Aviation Administration DOT/FAA/RD-92/18 (Aug. 27, 1992).
Abstract of "Anti-rutting Solutions" European Roads Review, (Dec. 20002).
Abstract of "Formate Durability of Road Pavements—Literature Survey and Laboratory Tests" Tiehallinnon Selvityksia, Finnra Reports (2002), no month provided, vol. 24/2002, No TIEH 3200756.
Abstract of "Towards a performance related seal design method: New empirical test method using scaled down APT and theoretical performance model" International Society for Asphalt Pavements, Ninth International Conference on Asphalt Pavements, 2003, no month provided, vol. 2.
Abstract of "Performance-graded binder specification for surface treatments" Transportation Research Record, No. 1810, 2002, no month provided.
Abstract of "Assessment of a temperature-sensitive bitumen for chipsealing on New Zealand roads" Transfund New Zealand Research Report, (1999), no month provided, No. 154.
Abstract of "Initial adhesion characteristics of polymer modified binders" Transfund New Zealand Research Report (2000) no month provided, No. 178.
Abstract of "High temperature performance grade specification of asphalt binder from the material's volumetric-flow rate" Materials and Structures, vol. 34 (No. 244), no month provided.

* cited by examiner

METHOD OF SELECTING A BINDER FOR A CHIPSEALING PROCESS BASED ON ITS ADHESION INDEX

CROSS-REFERENCE TO RELATED APPLICATIONS

Not Applicable.

STATEMENT REGARDING FEDERALLY SPONSORED RESEARCH OR DEVELOPMENT

Not applicable.

BACKGROUND OF THE INVENTION

The present invention relates to a method of paving a roadway. More specifically, this method includes choosing a bituminous binder for a chipsealing process based on its Adhesion Index.

Hot applied chipseals commonly are applied to pave or upgrade a roadway. However, one disadvantage with conventional chipseals is pervasive aggregate loss over time.

In an attempt to overcome excessive aggregate loss, aggregate has been precoated with bitumen to increase its adhesion in the chipsealing process. Many bitumen coatings will completely cover the aggregate material. One disadvantage with precoatings is that if too much bitumen is added, the aggregate will stick together and form clumps. Another disadvantage with precoating aggregate is that it is expensive due to the additional materials needed and because handling the precoated aggregate is costly.

Methods to increase the embedment of aggregate in the binder also have been tried. One such method involves applying a thicker layer of bitumen to improve adhesion. One disadvantage of such a method is that this creates additional expense.

Antistripping agents also have been added to bitumen to help the adhesion of aggregate to the bitumen. However, even when using such agents, aggregate loss is still problematic. Another disadvantage of using antistripping agents is that they are costly.

Typically, to ensure maximum adhesion, the chipsealed surface is compacted or rolled. One disadvantage with compaction is that it is an additional step in the paving process increasing the time and cost of the chipsealing process. Further, it requires additional equipment. Still further, even with precoated aggregate, antistripping agents, higher embedment of aggregate, and compaction, excessive aggregate loss still occurs.

In order to overcome these disadvantages, a method of chipsealing a road that provides better aggregate adhesion is desired. This method should provide a way to select a binder for the chipsealing process that has good adhesion.

SUMMARY OF THE INVENTION

It is an object of the present invention to provide a better method for selecting a binder so that the binder's adhesion to aggregate is desirable and excessive aggregate is not lost when paving a surface.

The foregoing and other objects are achieved by the method of the present invention for selecting a binder for a chipsealing process. This method includes measuring the Adhesion Index of at least one binder and selecting a binder with a desirable Adhesion Index for the chipsealing process. The selected binder should have an Adhesion Index no greater than about 3.75, when calculated from 100 times the $\log_{10}$ of the viscosity of the binder at the highest temperature the binder reaches after contact with the aggregate multiplied by the inverse of the binder's penetration value at 25° C. Preferably, the selected binder is applied to a surface and then aggregate is applied as defined by the Adhesion Index of the binder to form a chipsealed surface. Preferably, substantially all of the aggregate bonds to the binder without the need for compacting the paved surface.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
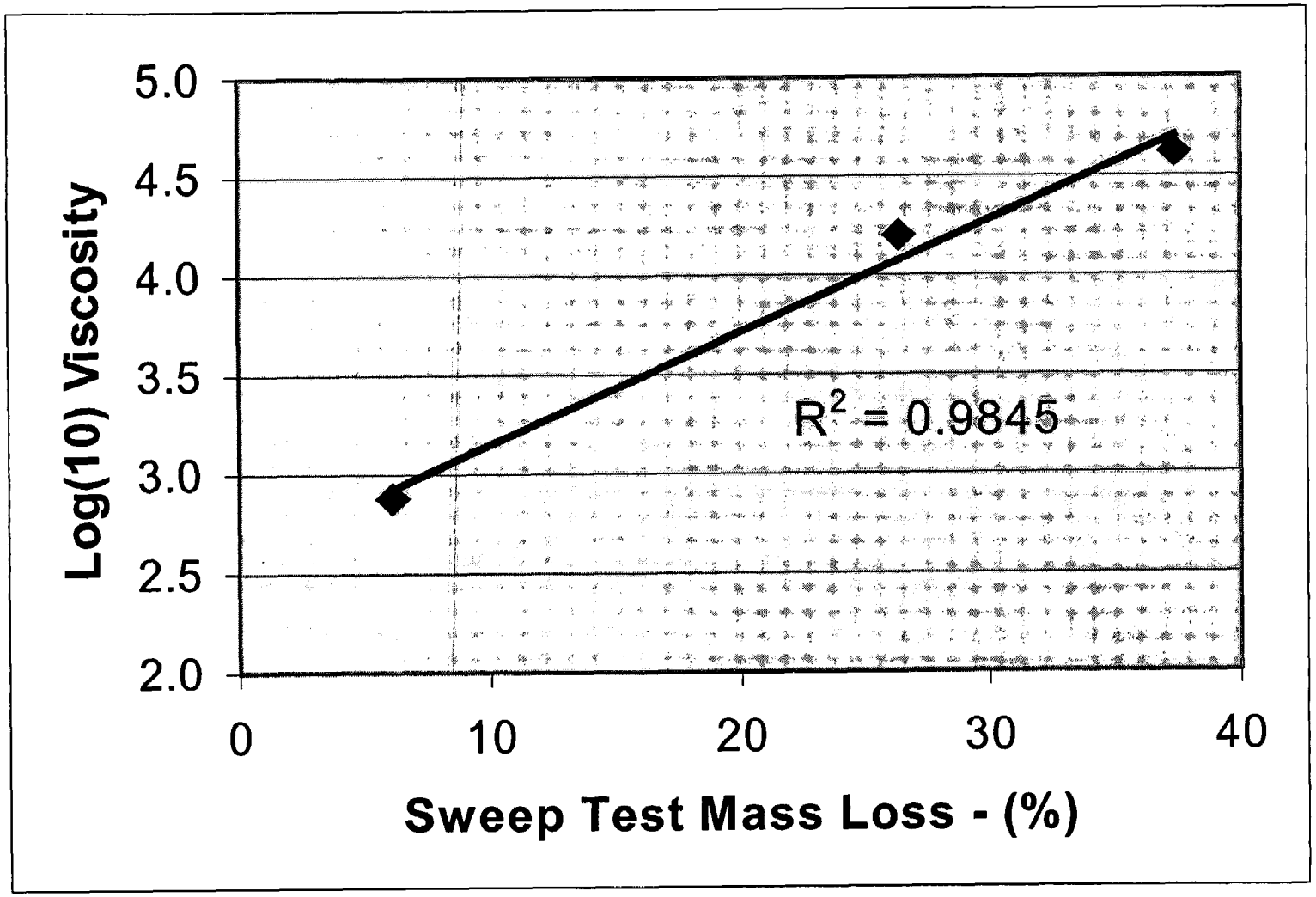
FIG. 1 is a graph showing the relationship between the logarithm of the viscosity of a bitumen binder and the Sweep Test mass loss of the aggregate.

The method of the present invention relates to selecting a binder appropriate for a chipsealing process. This method includes determining the Adhesion Index of at least one binder at one temperature and preferably determining the Adhesion Indexes of multiple binders at multiple temperatures.

Adhesion Index (AI) is defined as a rheological property of the binder at the highest temperature it reaches after contact with the aggregate multiplied by a rheological property of the binder at a temperature relatively near its in-service temperature on the surface to which it is applied. The rheological properties of the binder that are measured should increase as the binder becomes stiffer. If the selected rheological property decreases as the binder becomes stiffer, then the inverse of that rheological property should be used in calculating a binder's Adhesion Index. Logarithms of the rheological properties that are measured may be taken in order to achieve a more linear relationship. The Adhesion Index is a unitless number and provides an index that predicts adhesive properties of the binder.

Preferably, the binder's Adhesion Index is calculated using viscosity and penetration value measurements. Most preferably, the binder's Adhesion Index is the $\log_{10}$ of the viscosity (centipoise (cPs)) of the binder at the highest temperature it reaches after contact with the aggregate multiplied by the inverse of the binder's penetration value (decimillimeters (dmm)), and the resulting number is multiplied by 100. More specifically, most preferably, the binder's Adhesion Index is calculated according to the following equation:

$$AI = \log_{10}(\text{viscosity (cPs) at binder's highest temperature after aggregate contact}) \times (1/\text{penetration value (dmm) at 25° C.}) \times 100$$

The inverse of the binder's penetration value is used so that this rheological property increases as the stiffness of the binder being tested increases.

Typically, a hot binder is applied and its temperature decreases once it is applied to a surface, and upon aggregate application, its temperature continues to decrease. However, if hot aggregate is used, the binder's temperature may increase for a few seconds after aggregate application.

A binder's Adhesion Index varies depending upon its temperature. In order to determine the Adhesion Index of a binder at various temperatures, its viscosity is measured at various temperatures. The penetration of the bitumen binder is also measured relatively near its in-service temperature. The penetration value may be measured at any temperature below the softening point of the binder and above the glass transition temperature of the binder, such temperatures are considered near the in-service temperature. This typically is between about −30 and 50° C. Preferably, the penetration value is measured at a temperature of about 15-35° C. More preferably, it is measured at a temperature of about 25-30° C. Most preferably, the penetration of the bitumen is measured according to ASTM D5.

It is contemplated and included within the scope of the present invention that other rheological properties (i.e., shear modulus, melt index, toughness, dynamic shear modulus) could be measured to determine the Adhesion Index of the binder.

After the Adhesion Indexes of the tested binders are calculated, a binder is selected for the chipsealing process based on its Adhesion Index. The selected binder should have an Adhesion Index of no more than about 3.75 when calculated according to the most preferred method of the present invention in order to adhere about 80% of the aggregate applied thereto. Preferably, the selected binder has an Adhesion Index of no more than about 3.5 when measured as defined above. Most preferably, the selected binder has an Adhesion Index of no more than about 3.25 when measured as defined above. In many cases, the selected binder includes a polymer, modifier, and/or oil added to the bitumen. The ideal binder will have a low Adhesion Index while providing a high enough modulus to withstand high temperatures under traffic.

The selected binder is applied to a surface followed by aggregate being applied on the binder. Preferably, the binder and aggregate are applied using a single vehicle, which allows for more precise control of the time between application of the bitumen and aggregate. Preferably, they are applied in a continuous process. Preferably, the aggregate is applied within 10 seconds of the binder. More preferably, the aggregate is applied within 5 seconds of the binder. Most preferably, the aggregate is applied within 1 second of the binder. This shortens the time that the binder is allowed to cool and thus keeps the binder's Adhesion Index value lower. Preferably, the aggregate is applied when the binder has a temperature of at least about 80° C. More preferably, the aggregate is applied when the binder has a temperature of at least about 95° C. Most preferably, the aggregate is applied when the binder has a temperature of at least about 110° C. Alternatively, a cooler binder may be applied followed by the application of hot aggregate so as to raise the binder's temperature to at least about 80° C., preferably at least about 95° C., and most preferably at least about 110° C.

However, equipment alone cannot guarantee an acceptable Adhesion Index. Table 1 shows the Adhesion Index, which is calculated according to the most preferred method of the present invention, of three different commercially available hot applied chipseal binders at various application temperatures. Two of the examples shown in this table represent typical application times using multiple pieces of equipment, namely, applying aggregate about 15 or 30 seconds after binder is applied. It is less typical to apply aggregate within 10 seconds after the binder is applied, as done in the last example in Table 1, when using multiple pieces of equipment due to equipment logistics and safety concerns. A 150° C. storage temperature was used. An immediate temperature loss of 20° C. was used for the initial spray followed by standard enthalpy loss transferring to the substrate thereafter.

TABLE 1

| | | Adhesion Index (calculated according to most preferred method of the present invention) | | |
|---|---|---|---|---|
| Aggregate Application Time | AC Temp | AC-15P | AC-15XP | AC 15-5TR |
| 30 seconds | 60° C. | 3.9 | 5.0 | 7.8 |
| 15 seconds | 75° C. | 3.5 | 4.6 | 7.0 |
| 10 seconds | 95° C. | 2.9 | 3.8 | 5.9 |

Table 2 details the Adhesion Index for the three chipseal binder samples as applied by a single piece of equipment using a synchronous process.

TABLE 2

| Synchronous Process 1 second | | Adhesion Index (calculated according to most preferred method of the present invention) | | |
|---|---|---|---|---|
| application | AC Temp | AC-15P | AC-15XP | AC15-5TR |
| | 130° C. | 2.1 | 2.8 | 4.5 |

While the Adhesion Index values shown in Table 2 are more desirable than most of the values shown in Table 1, all of the synchronous process Adhesion Index values do not meet the criteria of the present invention. Having a higher binder temperature at the time of aggregate application positively affects the binder's Adhesion Index, but it may not be sufficient to make an undesirable binder acceptable. Increased binder temperature alone is not the solution to improve binder/aggregate adhesion. Tables 1 and 2 illustrate that both binder formulation and application conditions play important roles in providing binders with desirable Adhesion Indexes. As shown in Tables 1 and 2, AC-15P provides the best Adhesion Index numbers. Meanwhile, the data in these tables shows that AC15-5TR may never meet the Adhesion Index criteria of the present invention. By using the method of the present invention to formulate a desirable binder and determine an acceptable aggregate application time, superior chipsealed roads can be created.

Preferably, it is not necessary to compact the aggregate and binder in the chipsealing process of the present invention because there will be desirable adhesion without a compacting step. It is desirable to test the adhesion of the selected binder with the aggregate in a laboratory setting before chipsealing a chosen surface.

Preferably, a Sweep Test is used to measure the bonding force between the hot applied bituminous binder and the aggregate. As bonding strength increases, the Sweep Test mass loss will decrease. The importance of this invention can be seen in adhesive failure rates as established by the Sweep Test. In this test, a chipseal specimen is physically abraded. More specifically, a constant force is imparted on the chipsealed surface in an effort to dislodge aggregate. The Sweep Test is performed below the softening point of the binder and above the glass transition temperature. This typically is between about −30° C. and 50° C. Preferably, the Sweep Test is performed at a temperature of about 15-35° C. More preferably, it is performed at a temperature of about 25-30° C. Most preferably, the Sweep Test is performed at or near the temperature that penetration is measured.

Figure 2:
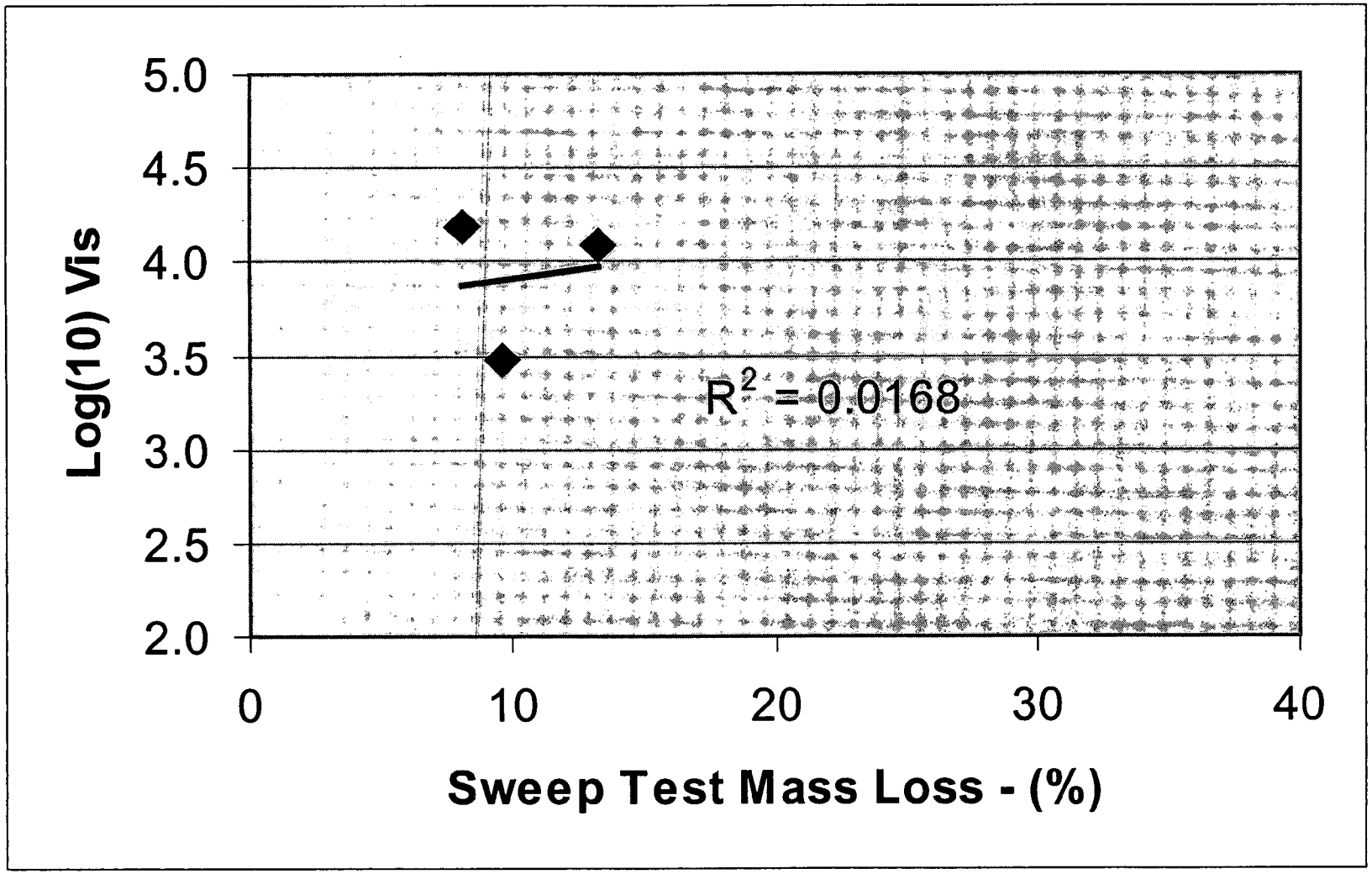
FIG. 2 is a graph showing the relationship between the logarithm of the viscosity of a bitumen binder and the Sweep Test mass loss of the aggregate.
Figure 3:
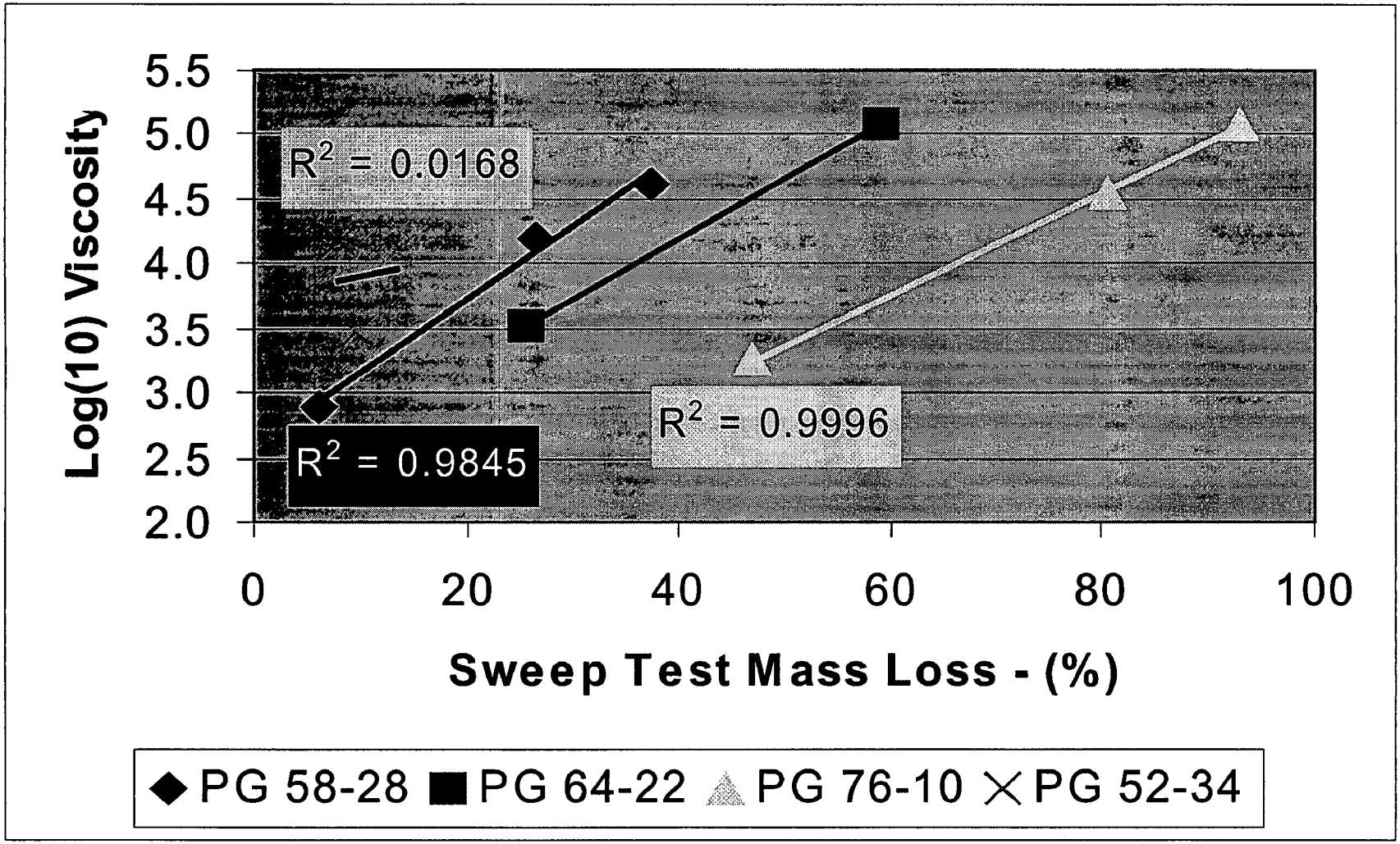
FIG. 3 is a graph showing the relationship between the viscosity of four different bitumen samples, ranging from very soft to very hard, each at different potential aggregate application temperatures and the Sweep Test mass loss of the aggregate at those particular temperatures.

Viscosity alone is not necessarily an adequate predictor of adhesion or Sweep Test mass loss, as evidenced by FIGS. 1-3. FIG. 1 shows the relationships between viscosity and Sweep Test mass loss for a particular binder at various possible aggregate application temperatures. FIG. 2 shows the same relationship for a different binder but shows no correlation between viscosity and Sweep Test mass loss. FIG. 1 shows that as the viscosity increases, the bonding force weakens detailed by higher Sweep Test mass loss, but this relationship does not exist for the binder tested in FIG. 2. Thus, FIGS. 1 and 2 show that a bitumen's viscosity at the time of aggregate application cannot be used exclusively as a clear indicator of adhesion.

FIG. 3 shows the same relationship as graphed in FIGS. 1 and 2 for four samples of bitumen, ranging from very soft to very hard, each at different temperatures. While three of the four binders show a consistent relationship between the viscosity of the bitumen at various temperatures as aggregate is applied and the Sweep Test mass loss, there is no predictable relationship between viscosity and Sweep Test mass loss among the different binders. This again shows that a bitumen's viscosity at the time of aggregate application is not a clear indicator of adhesion properties.

Figure 4:
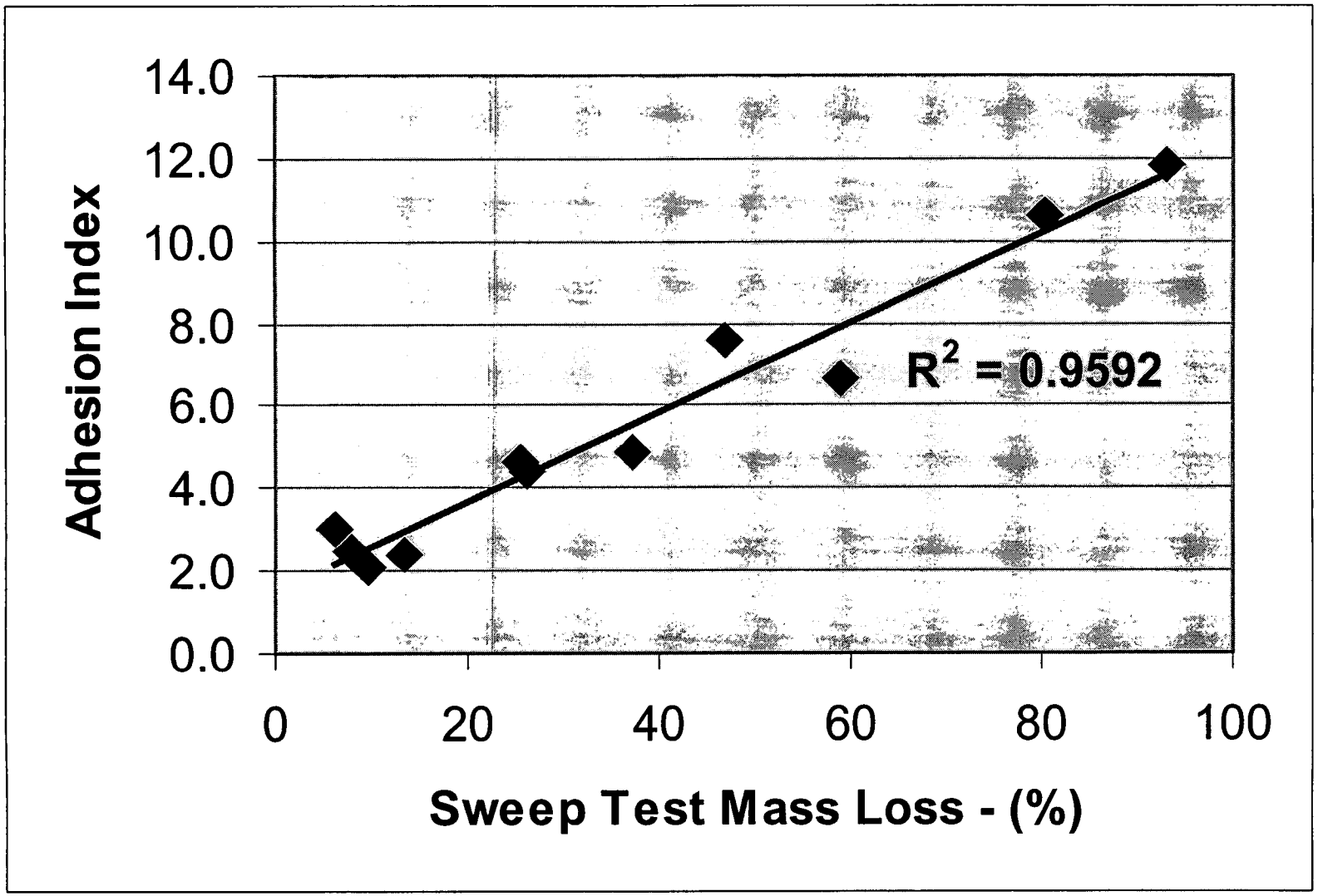
FIG. 4 is a graph showing the Adhesion Index of various bitumen binders versus the Sweep Test mass loss of aggregate applied to the corresponding binder.

In contrast, a binder's Adhesion Index shows a strong correlation with the Sweep Test mass loss of a surface that is chipsealed with the binder. As seen in FIG. 4, the Adhesion Indexes were calculated according to the most preferred method of the present invention for four sources of bitumen, ranging from very soft to very hard, each at various temperatures. This data shows that a binder's Adhesion Index has a strong degree of accuracy in predicting Sweep Test mass loss, as demonstrated by an $R^2$ of 0.96 in the graph of FIG. 4. FIG. 4 shows a direct link between the Adhesion Index and the Sweep Test mass loss for a variety of types of bitumen.

Figure 5:
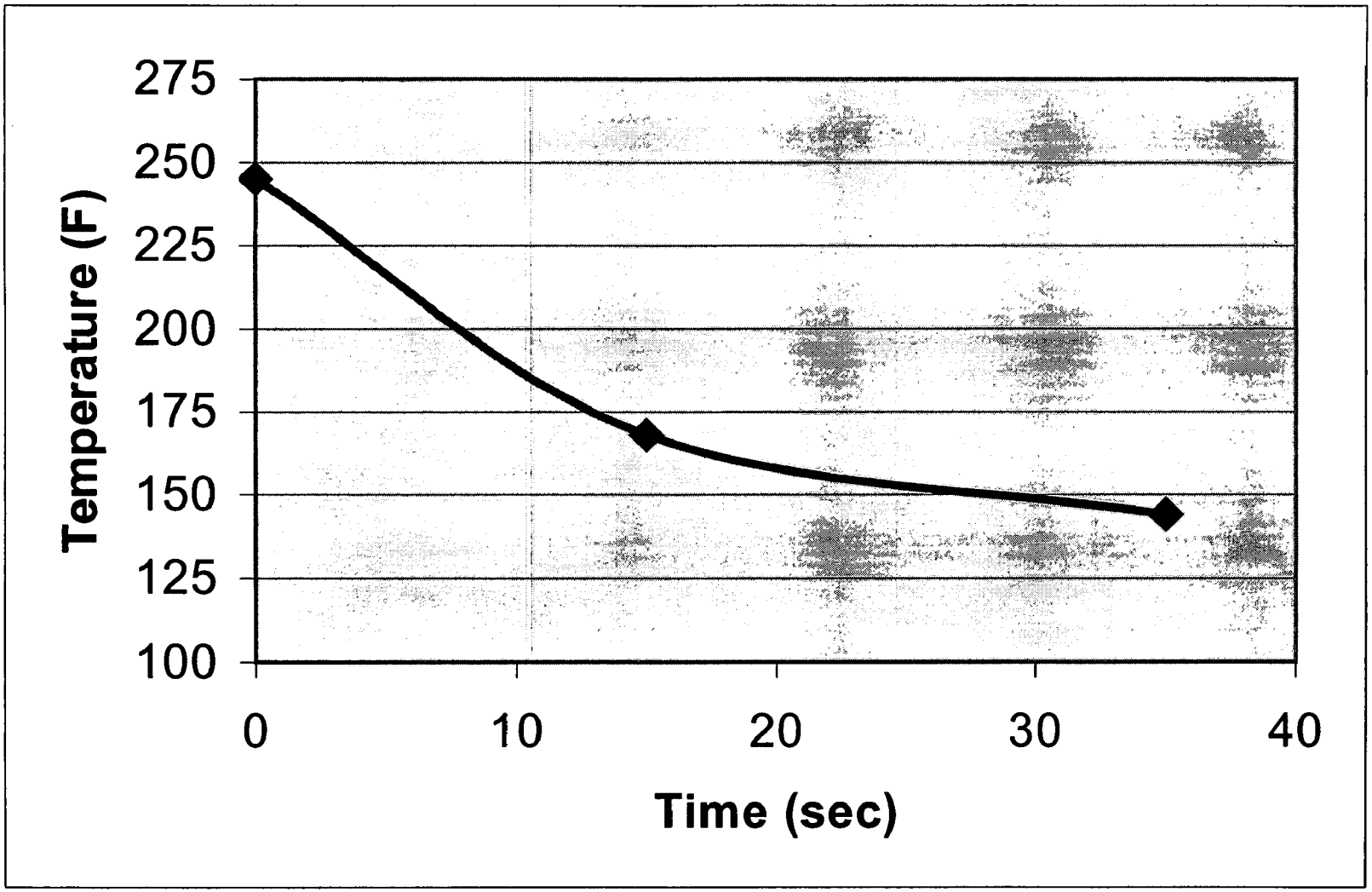
FIG. 5 is a graph showing the heat loss over time of hot bitumen as it cools after being applied on a surface.

In the chipsealing process, the hot bitumen binder cools at a very high rate with the majority of its heat loss taking place in the first 10 seconds after application, as seen in FIG. 5. This is why the Adhesion Index of the binder is affected significantly by the time period between when the binder is applied and when the aggregate is applied. Nevertheless, as discussed previously, binder temperature alone may not be sufficient to make an undesirable binder acceptable.

At least about 1500 square meters should be paved while the Adhesion Index of the binder remains no greater than about 3.75, when calculated according to the most preferred method of the present invention. Preferably, at least about 3000 square meters are paved while the Adhesion Index of the binder remains no greater than about 3.75, when calculated according to the most preferred method of the present invention. More preferably, at least about 6000 square meters are paved while the Adhesion Index of the binder remains no greater than about 3.75, when calculated according to the most preferred method of the present invention. Most preferably, the Adhesion Index of said binder remains no greater than about 3.75 for the entire paving process. Substantially all of the aggregate should bond to the binder when the process of the present invention is followed. Preferably, at least about 80% of the aggregate bonds to the binder. Most preferably, at least about 90% of the aggregate bonds to the binder.

Using the method of selecting a binder of the present invention, the use of unnecessarily high bitumen embedment levels, pre-coated aggregate, anti-stripping agents, and/or compaction are not necessary to ensure aggregate adhesion. Further, the present invention provides a way to monitor and control the quality of the process in the field. Nevertheless, the method of the present invention can be used even when using high embedment levels, pre-coated aggregate, anti-stripping agents or compaction.

From the foregoing it will be seen that this invention is one well adapted to attain all ends and objectives hereinabove set forth, together with the other advantages which are obvious and which are inherent to the invention.

Since many possible embodiments may be made of the invention without departing from the scope thereof, it is to be understood that all matters herein set forth or shown in the accompanying figures are to be interpreted as illustrative, and not in a limiting sense. The examples discussed herein are not meant in any way to limit the scope of the present invention.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

I claim:

1. A method of selecting a binder for a chipsealing process, comprising:

providing at least one binder;

determining Adhesion Index of said at least one binder; and selecting a binder for said chipsealing process after determining said Adhesion Index and based on said Adhesion Index of said at least one binder.

2. The method of claim 1 wherein said selected binder has an Adhesion Index no greater than about 3.5, when calculated from 100 times the $\log_{10}$ of viscosity (centipoises) of said binder at said binder's highest temperature reached after contact with aggregate multiplied by the inverse of said binder's penetration value (decimillimeters) at 25° C.

3. The method of claim 1 wherein said selected binder has an Adhesion Index no greater than about 3.75, when calculated from 100 times the $\log_{10}$ of viscosity (centipoises) of said binder at said binder's highest temperature reached after contact with aggregate multiplied by the inverse of said binder's penetration value (decimillimeters) at 25° C.

4. The method of claim 3, further comprising:

performing a Sweep Test to verify said at least one binder's adhesion before selecting said binder for said chipsealing process.

5. The method of claim 3, further comprising:
applying said selected binder to a surface; and
applying aggregate to said surface after applying said binder to form a chipsealed surface.

6. The method of claim 5 wherein said aggregate is in contact with said binder at a temperature of at least about 80° C.

7. The method of claim 5 wherein said aggregate is in contact with said binder at a temperature of at least about 95° C.

8. The method of claim 5 wherein said aggregate is in contact with said binder at a temperature of at least about 110° C.

9. The method of claim 5 wherein said binder and said aggregate are applied to said surface using a single piece of equipment.

10. The method of claim 9 wherein said application of binder and aggregate is a substantially continuous synchronous process.

11. The method of claim 10 wherein at least about 1500 square meters of a chipsealed surface are formed while said selected binder's Adhesion Index substantially remains no greater than about 3.75.

12. The method of claim 10 wherein at least about 3000 square meters of a chipsealed surface are formed while said selected binder's Adhesion Index substantially remains no greater than about 3.75.

13. The method of claim 10 wherein at least about 6000 square meters of a chipsealed surface are formed while said selected binder's Adhesion Index substantially remains no greater than about 3.75.

14. The method of claim 5 wherein said chipsealed surface is not compacted with a roller.

15. The method of claim 5 wherein said aggregate is distributed on said surface within about 5 seconds of when said binder is applied.

16. The method of claim 5 wherein said aggregate is distributed on said surface within about one second of when said binder is applied.

17. The method of claim 5 wherein said selected binder is comprised of asphalt and polymer.

18. The product of the method of claim 5.

19. A method of paving a surface, comprising:
applying an asphalt binder to said surface; and
distributing aggregate on said asphalt binder in such a manner that the Adhesion Index of said binder substantially remains no greater than about 3.75, when calculated from 100 times the $\log_{10}$ of viscosity (centipoises) of said binder at said binder's highest temperature reached after contact with said aggregate multiplied by the inverse of said binder's penetration value (decimillimeters) at 25° C., while paving said surface.

20. The method of claim 19 wherein said paved surface is not compacted with a roller.

21. The method of claim 19 wherein said aggregate is distributed on said asphalt binder while said binder's Adhesion Index substantially remains no greater than about 3.5.

22. The method of claim 19 wherein said aggregate is distributed on said asphalt binder while said binder's Adhesion Index substantially remains no greater than about 3.25.

23. The method of claim 19 wherein at least about 80% of said aggregate bonds to said binder.

24. The method of claim 19 wherein at least about 90% of said aggregate bonds to said binder.

25. The method of claim 19 wherein said aggregate is in contact with said binder at a temperature of at least about 80° C.

26. The method of claim 19 wherein said aggregate is in contact with said binder at a temperature of at least about 95° C.

27. The method of claim 19 wherein said aggregate is in contact with said binder at a temperature of at least about 110° C.

28. The method of claim 19 wherein said surface is at least about 1500 square meters.

29. The method of claim 19 wherein said surface is at least about 3000 square meters.

30. The method of claim 19 wherein said surface is at least about 6000 square meters.

31. The method of claim 19 wherein said binder's Adhesion Index is no greater than about 3.75 for the entire paving process.

32. The product of the method of claim 19.

33. A method of paving a surface, comprising:
applying an asphalt binder to said surface; and
distributing aggregate on said asphalt binder in such a manner that the Adhesion Index of said binder substantially remains no greater than about 3.75, when calculated from 100 times the $\log_{10}$ of viscosity (centipoises) of said binder at said binder's highest temperature reached after contact with said aggregate multiplied by the inverse of said binder's penetration value (decimillimeters) at 25° C., while paving said surface,
wherein said aggregate is in contact with said binder at a temperature of at least about 80° C., said surface is at least about 6000 square meters, and said aggregate is distributed on said surface within about 5 seconds of when said binder is applied.

34. The method of claim 33 wherein said aggregate is distributed on said asphalt binder while said binder's Adhesion Index substantially remains no greater than about 3.5.

35. The method of claim 33 wherein said aggregate is distributed on said asphalt binder while said binder's Adhesion Index substantially remains no greater than about 3.25.

* * * * *